US007670234B1

(12) United States Patent
Kellerman

(10) Patent No.: US 7,670,234 B1
(45) Date of Patent: Mar. 2, 2010

(54) GOLF CLUB SYSTEM

(76) Inventor: James Kellerman, 1415 Main St., #407, Palm Harbor, FL (US) 34698

( * ) Notice: Subject to any disclaimer, the term of this patent is extended or adjusted under 35 U.S.C. 154(b) by 0 days.

(21) Appl. No.: 11/983,554

(22) Filed: Nov. 9, 2007

Related U.S. Application Data

(63) Continuation-in-part of application No. 11/636,931, filed on Dec. 11, 2006, now abandoned.

(60) Provisional application No. 60/783,340, filed on Mar. 17, 2006.

(51) Int. Cl.
*A63B 53/04* (2006.01)

(52) U.S. Cl. ..... 473/314; 473/324

(58) Field of Classification Search ..... 473/314, 473/324, 343–344, 345, 350
See application file for complete search history.

(56) References Cited

U.S. PATENT DOCUMENTS

| | | | | | |
|---|---|---|---|---|---|
| 1,452,845 | A | * | 4/1923 | Pryde | 473/343 |
| 1,638,916 | A | | 8/1927 | Butchart | |
| 2,447,967 | A | * | 8/1948 | Stone | 473/332 |
| D154,496 | S | * | 7/1949 | Klein | D21/750 |
| 2,683,036 | A | * | 7/1954 | Klein | 473/349 |
| D190,035 | S | * | 4/1961 | Hansen | D21/751 |
| 3,250,536 | A | | 5/1966 | Moser | |
| D208,058 | S | * | 7/1967 | Johnston | D21/747 |
| 3,751,035 | A | * | 8/1973 | Lockwood | 473/290 |
| 3,858,886 | A | * | 1/1975 | Cosby | 473/350 |
| 3,869,126 | A | * | 3/1975 | Thompson | 473/331 |
| 3,961,796 | A | * | 6/1976 | Thompson | 473/328 |
| D248,179 | S | * | 6/1978 | Riley | D21/733 |
| 4,139,196 | A | * | 2/1979 | Riley | 473/242 |
| 4,157,830 | A | * | 6/1979 | Taylor et al. | 473/242 |
| 4,322,083 | A | * | 3/1982 | Imai | 473/344 |
| D291,107 | S | * | 7/1987 | Mendralla et al. | D21/750 |
| 4,804,184 | A | * | 2/1989 | Maltby | 473/409 |
| 5,465,968 | A | | 11/1995 | Aizawa et al. | |
| 5,536,012 | A | * | 7/1996 | D'Amico | 473/238 |
| 5,971,866 | A | * | 10/1999 | Adams et al. | 473/328 |
| 6,033,320 | A | * | 3/2000 | Bamberger | 473/314 |
| 6,186,905 | B1 | | 2/2001 | Kosmatka | |
| 6,248,026 | B1 | * | 6/2001 | Wanchena | 473/349 |
| 6,331,149 | B1 | * | 12/2001 | Mikame et al. | 473/330 |
| 6,572,489 | B2 | | 6/2003 | Miyamoto et al. | |
| 6,605,006 | B2 | * | 8/2003 | Mason | 473/252 |
| 6,830,519 | B2 | | 12/2004 | Read et al. | |
| 6,932,714 | B2 | | 8/2005 | Lovett | |
| 2004/0142768 | A1 | * | 7/2004 | Yokota | 473/371 |
| 2005/0282658 | A1 | * | 12/2005 | Amano | 473/345 |
| 2006/0194642 | A1 | * | 8/2006 | Sosin | 473/314 |

FOREIGN PATENT DOCUMENTS

| | | |
|---|---|---|
| GB | 2 360 462 | 9/2001 |

* cited by examiner

*Primary Examiner*—Stephen Blau
(74) *Attorney, Agent, or Firm*—Edward P Dutkiewicz

(57) ABSTRACT

A golf club system comprising a set of golf clubs, with each golf club having a face angle being between one and sixty five degrees from a plumb plane. Each golf club has a club head having an associated hosel. The hosel may have an offset configuration.

1 Claim, 4 Drawing Sheets

FIG 3
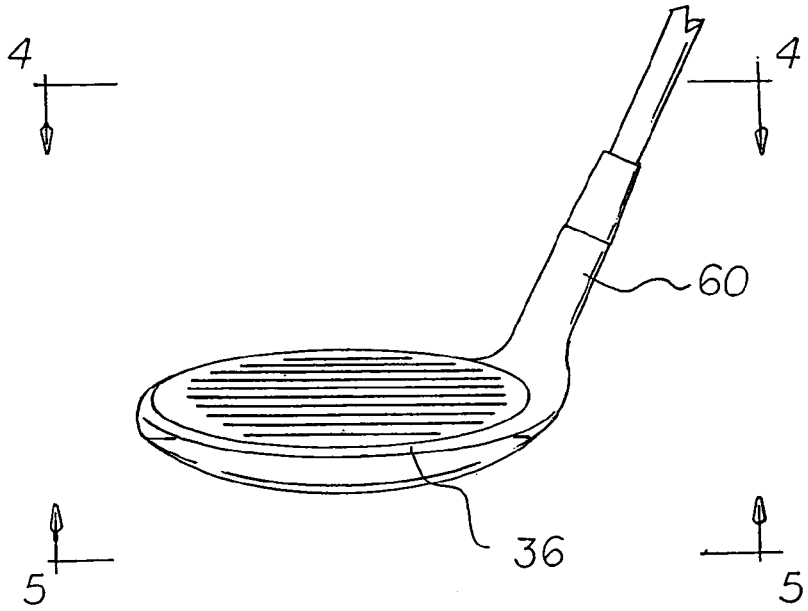
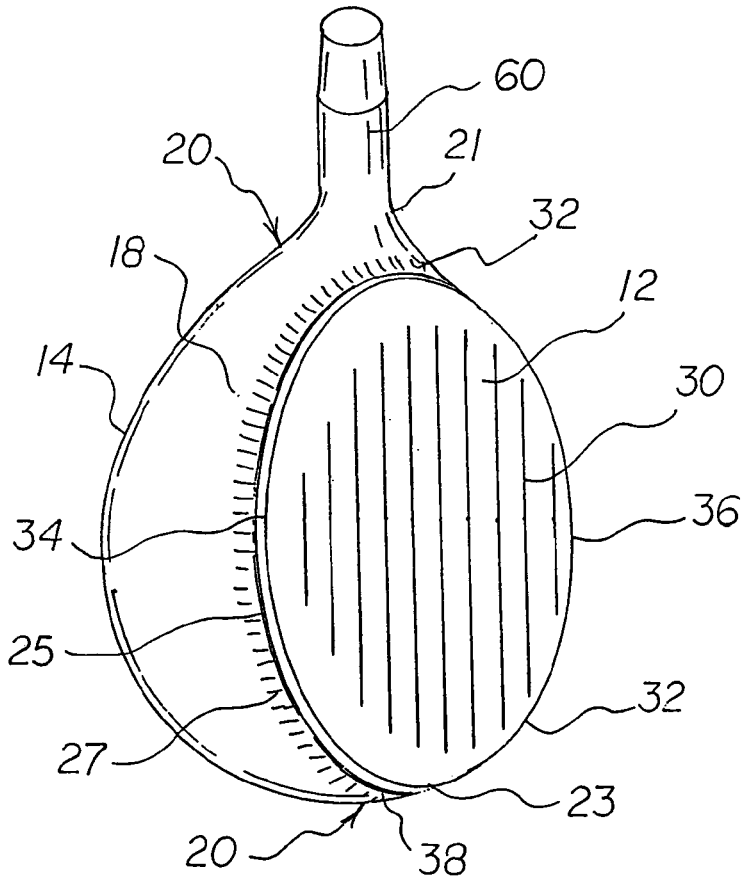
FIG 4

FIG 5
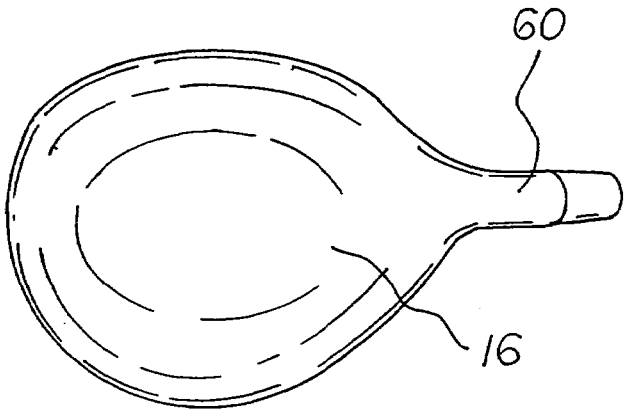
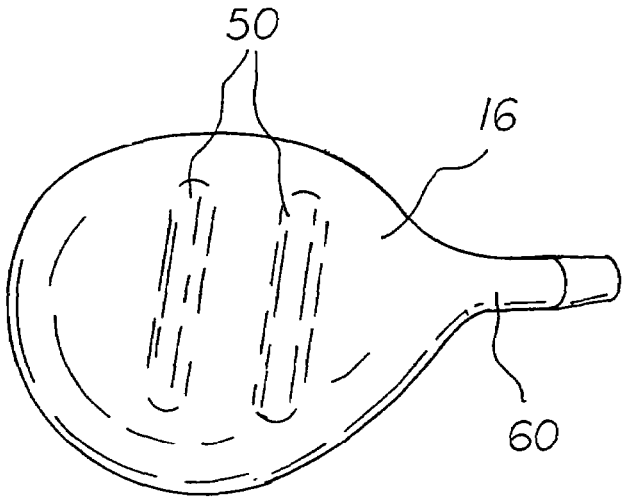
FIG 6

GOLF CLUB SYSTEM

RELATED APPLICATION

The present application is a continuation-in-part application of a non-provisional application bearing Ser. No. 11,636,931, filed Dec. 11, 2006 now abandoned and is currently before the Patent Office. The patent application is based upon a provisional application, bearing Ser. No. 60/783,340, filed on Mar. 17, 2006. The present application claims the priority of the previous applications.

NEW RULE 1.78(F)(1) DISCLOSURE

The Applicant has not submitted a related pending or patented non-provisional application within two months of the filing date of this present application. Previously submitted and pending related applications are disclosed herein infra. The invention is made by a single inventor, so there are no other inventors to be disclosed. This application is not under assignment to any other person or entity at this time.

BACKGROUND OF THE INVENTION

1. Field of the Invention

The present invention relates to a golf club system and more particularly pertains to providing a more efficient golf club.

2. Description of the Prior Art

The use of other configurations of a golf club is known in the prior art. More specifically, other configurations of a golf club previously devised and utilized for the purpose of allowing a more efficient golf club are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe a golf club system that allows the user to have a more efficient golf club.

In this respect, the golf club system, according to the present invention, substantially departs from the conventional concepts and designs of the prior art, and in doing so provides an apparatus primarily developed for the purpose of providing a more efficient golf club.

Therefore, it can be appreciated that there exists a continuing need for a new and improved golf club system which can be used for providing a more efficient golf club. In this regard, the present invention substantially fulfills this need.

SUMMARY OF THE INVENTION

In view of the foregoing disadvantages inherent in the known types of other configurations of a golf club now present in the prior art, the present invention provides an improved golf club system. As such, the general purpose of the present invention, which will be described subsequently in greater detail, is to provide a new and improved golf club system and method which has all the advantages of the prior art and none of the disadvantages.

To attain this, the present invention essentially comprises a golf club system comprising several components, in combination. First provided is set of golf clubs. Each club of the set has a club head. Each club head has a generally similar configuration. Each club head has a face portion, a rearward portion, a bottom portion, a top portion and two opposite side portions. The face portion comprises a golf ball striking portion. The golf ball striking portion has a generally flat surface with a plurality of linear groves running approximately parallel to the bottom portion. The face portion has an edge. The edge has a generally ovoid configuration with a top edge, a bottom edge and side edges. The top and bottom edges are longer than the side edges of the face portion edge. The face portion is located in a plane that is rearwardly angularly displaced from a plane perpendicular to the ground. The face angle is between about one degree and sixty degrees to the perpendicular plane. The bottom portion, top portion and the side portions are each adjacent to, and continuous, with the face portion, so as to form a solid configuration. The top portion has a generally flap top surface. The top portion has a place of head-to-shaft attachment, with the place of head-to-shaft attachment being located rearward and to the side of the face portion. The rearward portion has a generally elongated-from-side-to-side hyperbolic configuration with the surface of the rearward portion joining and being continuous with the top portion, the side portions, and the bottom portion, so as to form a solid configuration. The bottom portion has a generally flat configuration with the bottom portion joining the face, the rearward portion, and side portions. The side portions each have a generally rounded configuration and couple the face portion with the top portion, bottom portion, and rearward portion.

There is provided a golf club shaft coupled to each head of the set of golf clubs. The shaft has a coupling portion that is coupled to the golf club head, and a gripping portion which has a grip.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf club system which has all of the advantages of the prior art other configurations of a Golf Club and none of the disadvantages.

It is another object of the present invention to provide a new and improved golf club system which may be easily and efficiently manufactured and marketed.

It is further object of the present invention to provide a new and improved golf club system which is of durable and reliable constructions.

An even further object of the present invention is to provide a new and improved golf club system which is susceptible of a low cost of manufacture with regard to both materials and labor, and which accordingly is then susceptible of low prices of sale to the consuming public, thereby making such Golf club system economically available to the buying public.

Even still another object of the present invention is to provide a golf club system for providing a more efficient golf club.

Lastly, it is an object of the present invention to provide a new and improved golf club system comprising, in combination a set of golf clubs with each golf club having a generally similar head configuration. Each golf club has a club head, with the club head having a face portion comprising a golf ball striking portion, a top portion, a rearward portion and side portions. The top portion has a place of head-to-shaft attachment with the place of head-to-shaft attachment being located rearward and to the side of the face portion. Each club has a golf club shaft coupled to each head of the set of golf clubs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is frontal elevational view of the club head.

FIG. 4 is a top planar view of the club head taken along line 4-4 of FIG. 3.

FIG. 5 is a bottom planar view taken along line 5-5 of FIG. 3.

FIG. 6 is a bottom planar view that shows an alternate embodiment having a bottom surface with ridges.

The same reference numerals refer to the same parts throughout the various Figures.

DESCRIPTION OF THE PREFERRED EMBODIMENT

Figure 1:
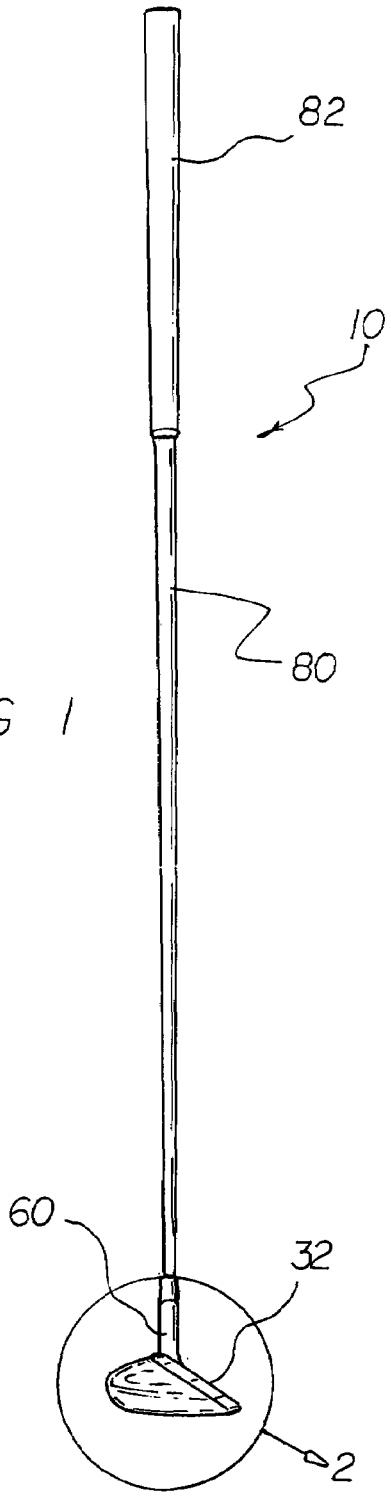
FIG. 1 is a side elevational view of the club.

With reference now to the drawings, and in particular to FIG. 1 thereof, the preferred embodiment of the new and improved golf club system embodying the principles and concepts of the present invention and generally designated by the reference numeral 10 will be described.

The present invention, the golf club system 10 is comprised of a plurality of components. Such components in their broadest context include a club head, a shaft having a handle, and a coupling member, known as a club hosel. Such components are individually configured and correlated with respect to each other so as to attain the desired objective.

A golf club system comprising several components, in combination. First provided is set of golf clubs. Each club of the set has a club head with the club heads each having a similar configuration. Of course, one skilled in the art would recognize that a single club, such as a wedge, may be fabricated as described herein below.

A golf club has several components, a grip, a shaft, a hosel, and a club head. The club head has several components, such as sides, top, bottom front and rear. The club also has a heel, which is the area on the side of the club where the hosel is located, and a toe area. The toe of the club is the area of the club most remote from the area where the hosel is coupled thereto.

The club head has a face portion, or ball striking portion 12, a rearward portion 14, a bottom portion 16, a top portion 18 and two opposite side portions 20. The club head, as described above, has a heel 21 and a toe 23.

The golf ball striking portion has a generally flat surface with a plurality of linear grooves 30 running approximately parallel to the bottom portion. The club face portion is made of rigid material, metals, such as steel, aluminum plastic, or non-metals. In the preferred embodiment the club has a lip 25 located above the golf ball striking region. The lip is formed by the uppermost extent of the top portion of the ball striking portion protruding upwards from the top portion of the club head. There is a sloping contour 27 connecting the lip and the top portion of the club head. The lip has a rearward surface that slopes downward and is continuous with the top of the club head. The lip is continuous from the sideward-most extent at the toe of the club head to the sideward-most extent at the heel of the club head.

In another embodiment there may be no grooves in the ball striking portion.

The golf ball striking portion, also known as the club face, has an associated continuous edge 32. The edge has a generally ovoid configuration with a top edge 34, a bottom edge 36 and side edges 38, forming a continuous golf ball striking portion edge having an uppermost edge. The ovoid configuration is continuous and uninterrupted. The ovoid edge of the ball striking region is separate from and forward of the hosel, or point of attachment of the shaft to the club head. The uppermost ovoid edge of the golf ball striking portion, when viewed from the area of the toe of the club, is in line with the hosel of the club head. The top and bottom edges of the ball striking portion are longer than the side edges of the face portion edge. The ball striking portion is located in a plane that is rearwardly angularly displaced from a plane perpendicular 40 to the ground, or a vertical line. The face angle 41 is between about one degree and sixty five degrees rearward of the perpendicular plane, or vertical line.

The bottom portion, top portion and the side portions are each adjacent to, and continuous with, the face portion, so as to form a solid configuration. In another embodiment, the bottom of the club head may have at least one ridge 50.

The top portion has a generally slightly curved, almost flat top surface with some further curving along the edges of the top so as to meet the sides and rearward portions. In general, the club head has a "wood-like" appearance, but with a greatly angled striking face. The top portion has a place of head-to-shaft attachment 60, with the place of head-to-shaft attachment, or hosel, being located rearward and to the side of the face portion. The location of the hosel is in line with the upper most edge of the ball striking portion. In the preferred embodiment the hosel of the club head is straight. The hosel is coupled to the upper portion of the club. There is a slight sloping depression separating the hosel and the ball striking portion, which is the continuation of the lip to the sidemost extent on the heel of the club head.

In another embodiment the hosel may be configured to have an offset, or angular configuration. Such a configuration is referred to as a gooseneck hosel 62. The hosel is offset in the forward direction so as to be forward of the ball striking portion of the club head.

The rearward portion of the club head has a generally elongated-from-side-to-side hyperbolic, or curved, configuration with the surface of the rearward portion joining and being continuous with the top portion, the side portions, and the bottom portion, so as to form a solid configuration.

Figure 2:
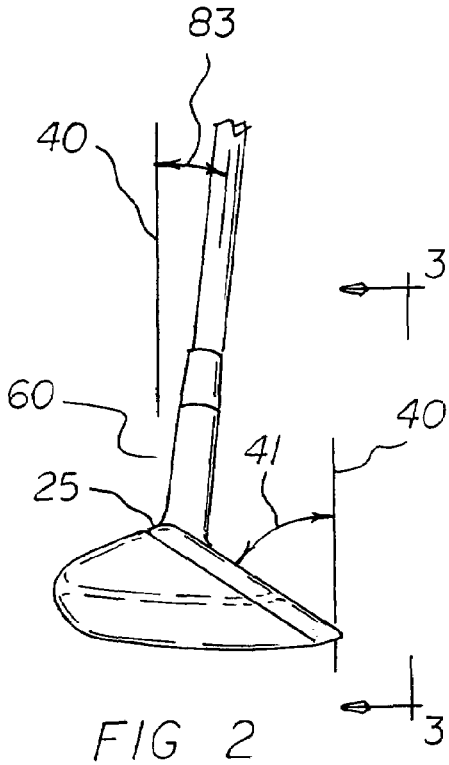
FIG. 2 is a close-up side elevational view of the club head taken from circle 2 of FIG. 1.
Figure 7:
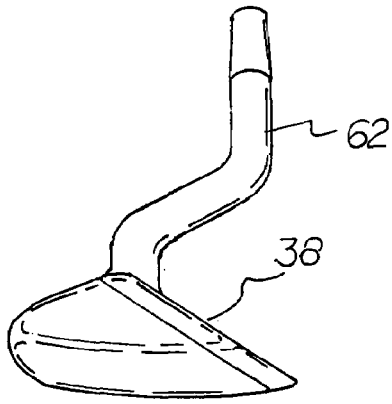
FIG. 7 is a side elevational close-up view of the club head and neck, showing the goose-necked hosel.
Figure 9:
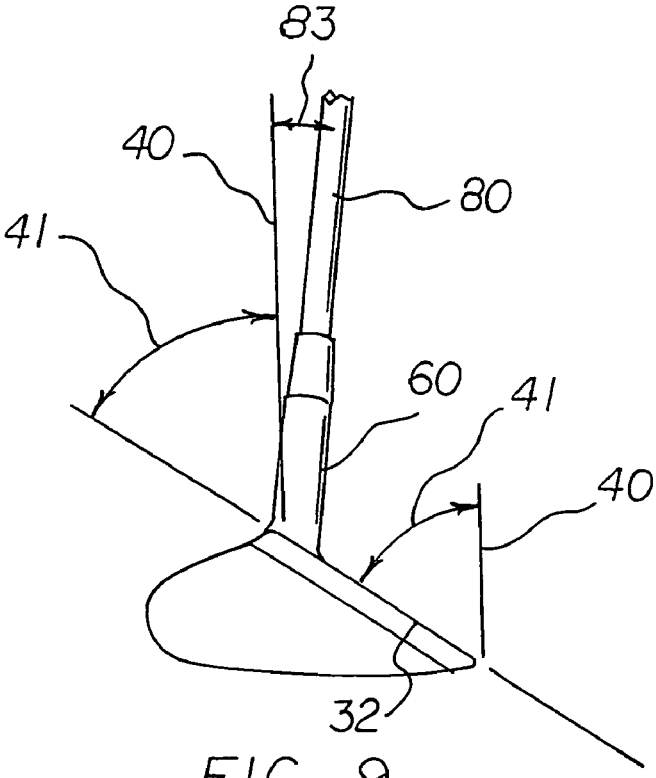
FIG. 9 is a side elevational view of a club having a 56 degree ball striking region and a 10 degree angle of the shaft. Note that the lowest point of the ball striking region and the lowest point of the bottom are essentially the same, giving no bounce angle.

The bottom portion of the club head has a generally slightly curved, almost flat, configuration with the bottom portion joining the face portion, the rearward portion, and side portions. The side portions each have a generally rounded, or curved, configuration and couple the face portion with the top portion, bottom portion, and rearward portion. The top portion of the club head having an upwards protrusion. The uppermost edge of the golf ball striking portion having an associated lip located above the golf ball striking portion, the lip being formed by the uppermost extent of the top edge of the ball striking portion and an upwards protrusion of the top portion of the club head, with a sloping contour connecting the lip and the top portion of the club head, as shown in FIGS. 2 and 7 reference item 27. The lip has a rearward surface that slopes downward and is continuous with the top of the club head, as shown in FIGS. 1, 2, 4, and 7. The bottom portion has a lowermost portion also referred to as the lowest point as shown in FIGS. 5 and 9. The advantage of this club configuration over the prior art is that the enlarged flat bottom portion is larger in this configuration than in the prior art, providing greater surface area for contact with the ground. The result is that the presently described club does not dig into the ground as easily as do clubs having a lesser area in contact with the ground, such as "irons", as is found in the prior art.

Figure 8:
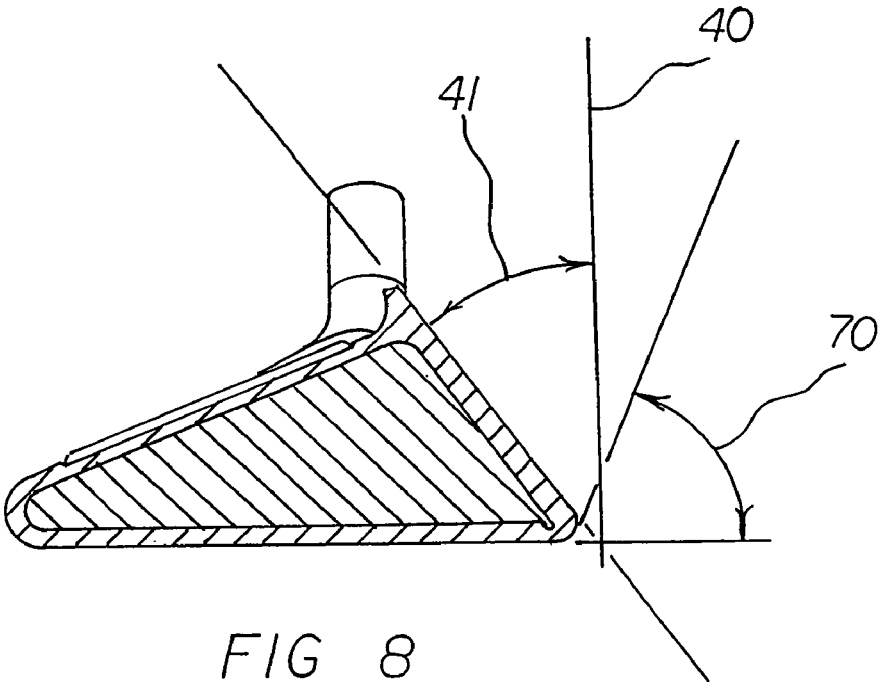
FIG 8 PRIOR ART
FIG. 8 is cross sectional view of prior art, demonstrating the bounce angle of the prior art.

The ball striking portion of the club is joined and continuous with the bottom portion. In the prior art, between the ball striking portion of the club head and the bottom of the club head is what is described as the "bounce angle" 70. The bounce angle is the angle formed by the intersection of the line following the club face-to-bottom coupling and the plane of the club head bottom when the club face is at the predetermined angle to the vertical. By this is meant that in the case of a sixty degree club ball striking portion, commonly referred to as a sixty degree face, when the ball striking portion is at sixty degrees to a line that is perpendicular to a level line (therefore a vertical line) then the bounce angle is determined to be that angle that exists for a line between the point or location where the club head is contacting the ground to the lowermost edge of the ball striking portion of the club head. FIG. 8 demonstrates the determination of a bounce angle in a prior art club. In the present invention, however, the club face has no bounce angle in that when the club face is at the predetermined angle the point of contact of the bottom of the club and the lowermost point of the ball striking portion are, essentially, one and the same, and therefore, the club ball striking portion has no bounce angle. FIG. 2 demonstrates a fifty six degree angled ball striking portion with a ten degree forward angle on the shaft. When the club strikes the ball during a swing the lowest point of the club ball striking portion and the bottom of the club are the same, and hence there is no bounce angle. Also it should be noted that the angulation of the shaft places the user's hands in front of the ball, as is properly the case. The significance of lowest ball striking portion and the lowest point of the club bottom being the same is that the bounce of a club means that the ball striking portion is not at the lowest point of the club head, meaning that the user cannot hit the ball lower than allowed by the bounce. In the present invention, the lack of a bounce angle means that the club ball striking portion is the lowest point and gets under the ball to the greatest extent possible, thereby providing a more efficient ball striking surface and greater lift on the ball.

There is provided a golf club shaft 80, having a length, coupled to the hosel of the golf club head. The hosel is the connector between the head of the club and the shaft of the club. Generally the hosel is located along side the club head face. In the present invention the hosel is located rearwardly of the club face, so that the ball strikes the club face before it can hit the hosel, thereby preventing what is commonly known as "shanking" the ball, or striking the ball with the hosel. Prior art describes the hosel being set back from the club face. The prior art, however, does not teach the hosel being in line with the uppermost edge of the ball striking portion, or the use of a larger sized flattened bottom and a club having the head configuration used in conjunction with the set back hosel, as taught by the present invention.

The shaft has a coupling portion that is coupled to the golf club head, and a gripping portion which has a grip 82. In the preferred embodiment the shaft length is varied. Of note, however, is the shaft angle. The shaft angle 83 is defined as that angle that the shaft has to a vertical line when the club ball striking portion is at the predetermined angle. For example, if a club ball striking portion is set at fifty six degrees then to determine the shaft angle, the ball striking portion is positioned so that it is fifty six degrees from the vertical, and the angle of the shaft is then determined. In the present invention the shaft angle is between about five degrees and twenty five degrees, angled forwardly of the vertical. The shaft angle provides the advantage of the user's hands being forward of the ball striking portion of the club at the time of the swing when the ball striking portion is first contacting a golf ball.

In another embodiment the shaft length may be only slightly varied.

In another embodiment the shaft length may be generally similar.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being desired to be protected by Letters Patent of the United States is as follows:

1. A golf club system comprising:

a golf club having shaft and a club head, the head having a top portion and a rearward portion and side portions and a bottom portion and a ball striking portion, the ball striking portion having a generally continuous ovoid configuration having an edge having an uppermost portion and lower most portion and two side portions being a heel and a toe, the golf ball striking portion having an associated lip located above the golf ball striking portion, the lip being formed by the uppermost extent of the top edge of the ball striking portion and an upwards protrusion of the top portion, the upwards protrusion has a sloping contour, the lip extending along the upper edge of the ball striking portion from the sideward-most extent at the toe of the club to the sideward-most extent at the heel of the club, the sloping contour slopes downward, the top portion having a place of head-to-shaft attachment known as a hosel with the place of head-to-shaft attachment being located on the heel side of the club in line with the uppermost edge of the ball striking portion and to the side of the ball striking portion, the ball striking portion having a predetermined angle from a vertical line, the bottom portion having a lowermost portion when the ball striking portion is at the predetermined angle, with the lowermost portion of the bottom portion of the club and the lowermost edge of the ball striking portion being essentially the same when the ball striking portion is at the predetermined angle.

* * * * *